US012723341B2

(12) United States Patent
Kim et al.

(10) Patent No.: US 12,723,341 B2
(45) Date of Patent: Sep. 1, 2026

(54) LAUNDRY TREATMENT APPARATUS

(71) Applicant: LG ELECTRONICS INC., Seoul (KR)

(72) Inventors: Younghun Kim, Seoul (KR); Kunwoo Kim, Seoul (KR); Sungwoon Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 105 days.

(21) Appl. No.: 18/700,165

(22) PCT Filed: Dec. 12, 2022

(86) PCT No.: PCT/KR2022/020090
§ 371 (c)(1),
(2) Date: Apr. 10, 2024

(87) PCT Pub. No.: WO2024/122698
PCT Pub. Date: Jun. 13, 2024

(65) Prior Publication Data

US 2025/0237001 A1 Jul. 24, 2025

(30) Foreign Application Priority Data

Dec. 9, 2022 (KR) ..... 10-2022-0171923

(51) Int. Cl.
*D06F 34/20* (2020.01)
*D06F 23/04* (2006.01)
(Continued)

(52) U.S. Cl.
CPC ..... *D06F 34/20* (2020.02); *D06F 23/04* (2013.01); *D06F 39/02* (2013.01); *D06F 39/14* (2013.01);
(Continued)

(58) Field of Classification Search
CPC ..... D06F 34/20; D06F 23/04; D06F 39/02; D06F 39/14; D06F 2103/00; D06F 2105/42
(Continued)

(56) References Cited

U.S. PATENT DOCUMENTS

2008/0072630 A1* 3/2008 Je ..... D06F 39/02 68/17 R
2019/0345661 A1* 11/2019 Ko ..... D06F 39/14
(Continued)

FOREIGN PATENT DOCUMENTS

JP 2022-522691 A 4/2022
JP 2022-80559 A 5/2022
(Continued)

OTHER PUBLICATIONS

JP2022080559A—machine translation (Year: 2022).*
KR20210027020A—machine translation (Year: 2021).*

*Primary Examiner* — Tinsae B Ayalew
(74) *Attorney, Agent, or Firm* — Birch, Stewart, Kolasch & Birch, LLP

(57) ABSTRACT

A laundry treatment apparatus includes a cabinet including a top cover equipped with an introduction port, a tub, and a storage which is provided at the top cover and at least a portion of which is exposed to the outside of the cabinet. The storage includes an installation unit, which is provided at the top cover so as to communicate with the tub, and a storage body, which is removably coupled to the installation unit and stores detergent therein. The storage body is separable from the installation unit when the storage body moves from a first position at which the storage body is coupled to the installation unit to a second position which is spaced apart from the first position in the width direction of the cabinet. The second position is defined in the width of the cabinet.

16 Claims, 13 Drawing Sheets

(51) Int. Cl.

| | |
|---|---|
| ***D06F 39/02*** | (2006.01) |
| ***D06F 39/14*** | (2006.01) |
| *D06F 103/00* | (2020.01) |
| *D06F 105/42* | (2020.01) |

(52) U.S. Cl.
CPC ..... *D06F 2103/00* (2020.02); *D06F 2105/42* (2020.02)

(58) Field of Classification Search
USPC ..... 68/12.02
See application file for complete search history.

(56) References Cited

U.S. PATENT DOCUMENTS

| | | | | |
|---|---|---|---|---|
| 2020/0325612 | A1 | 10/2020 | Chae et al. | |
| 2021/0332522 | A1 * | 10/2021 | Jung | D06F 39/12 |

FOREIGN PATENT DOCUMENTS

| | | | | | |
|---|---|---|---|---|---|
| JP | 2022-127188 | A | | 8/2022 | |
| JP | 2022-169163 | A | | 11/2022 | |
| KR | 10-2006-0093872 | A | | 8/2006 | |
| KR | 10-2010-0066172 | A | | 6/2010 | |
| KR | 10-2018-0080013 | A | | 7/2018 | |
| KR | 10-2020-0007549 | A | | 1/2020 | |
| KR | 20210027020 | A | * | 3/2021 | D06F 39/02 |
| KR | 10-2021-0131758 | A | | 11/2021 | |

* cited by examiner

【Figure 1】
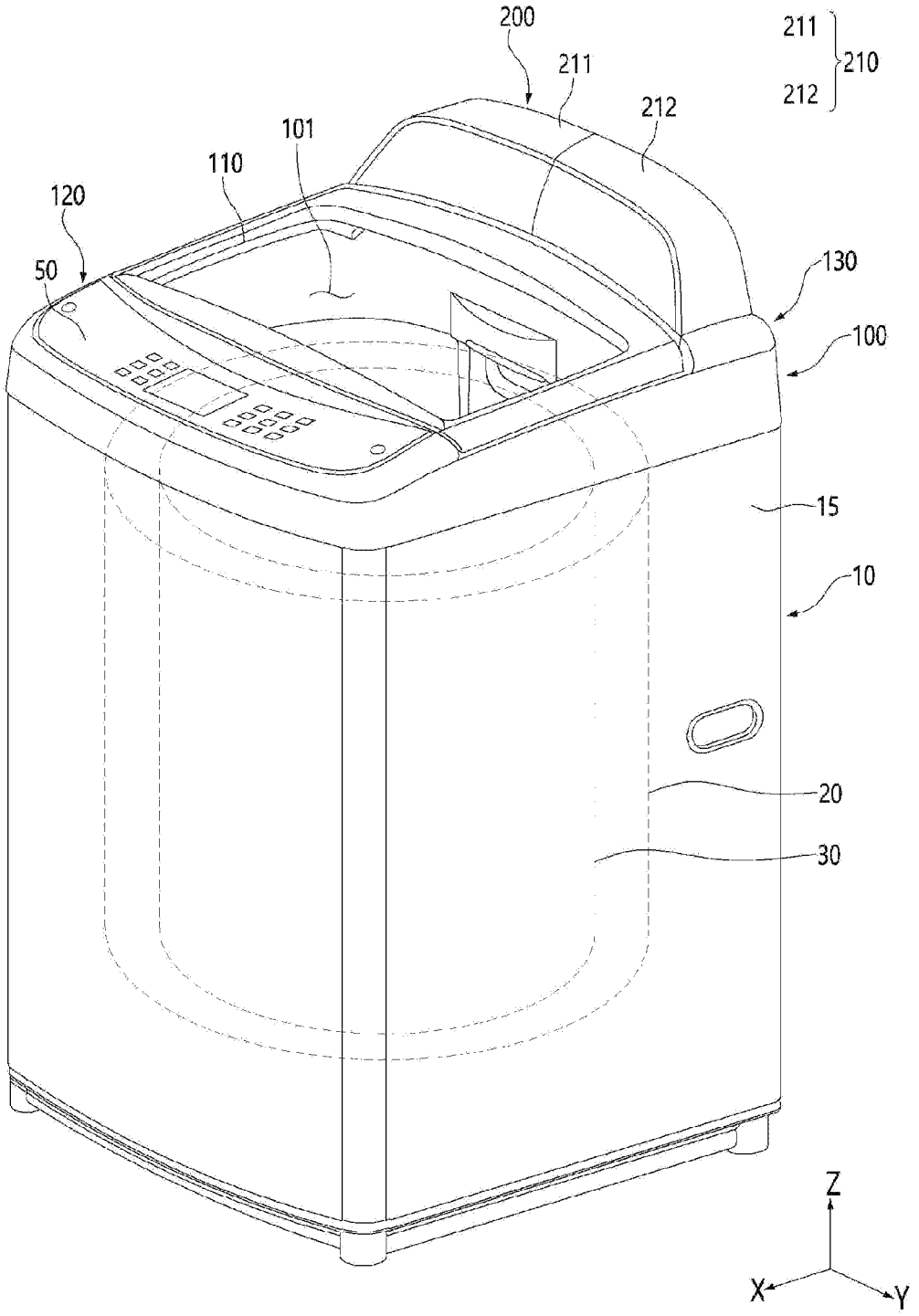

【Figure 2】
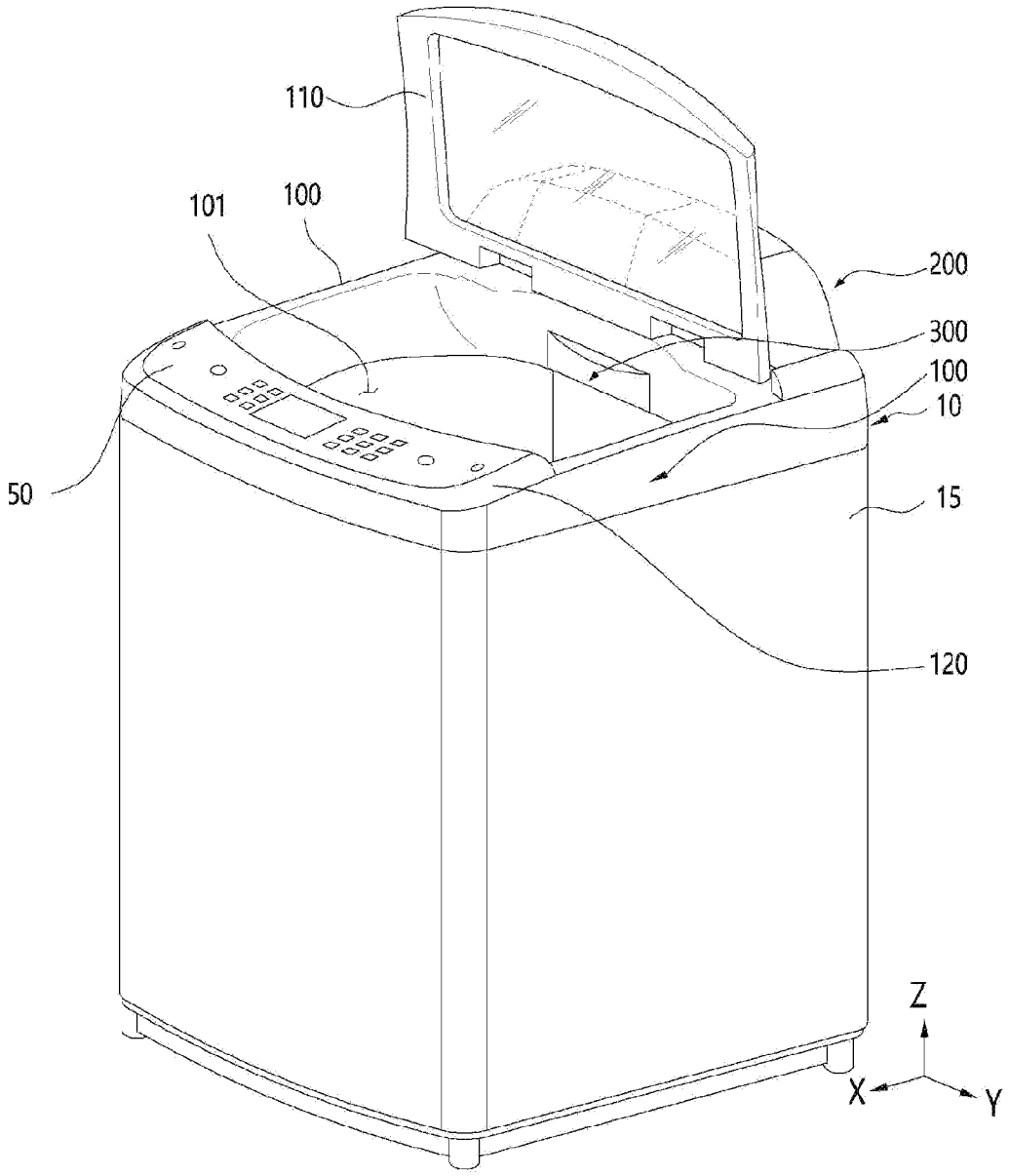

【Figure 3】
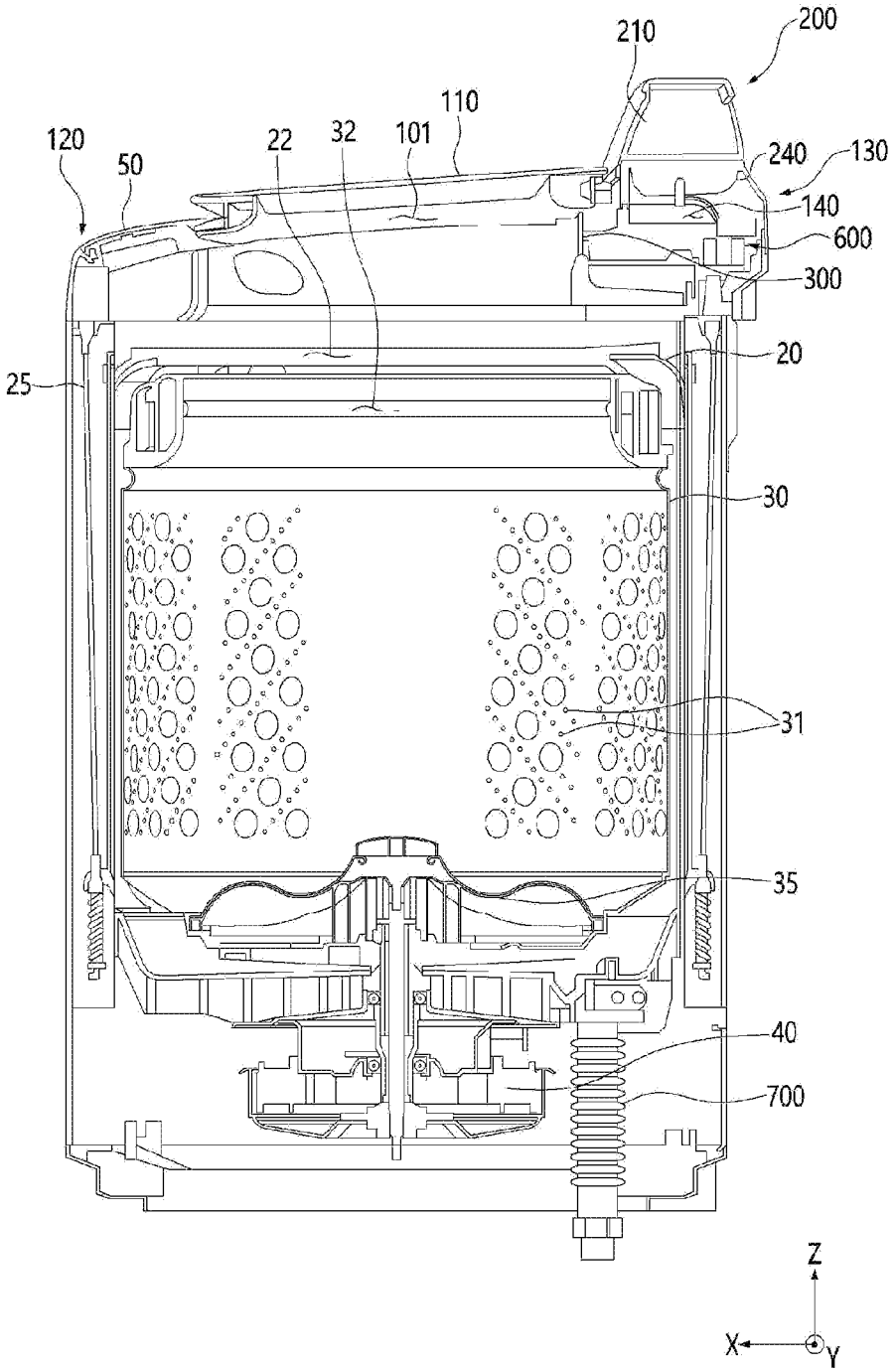

【Figure 4】
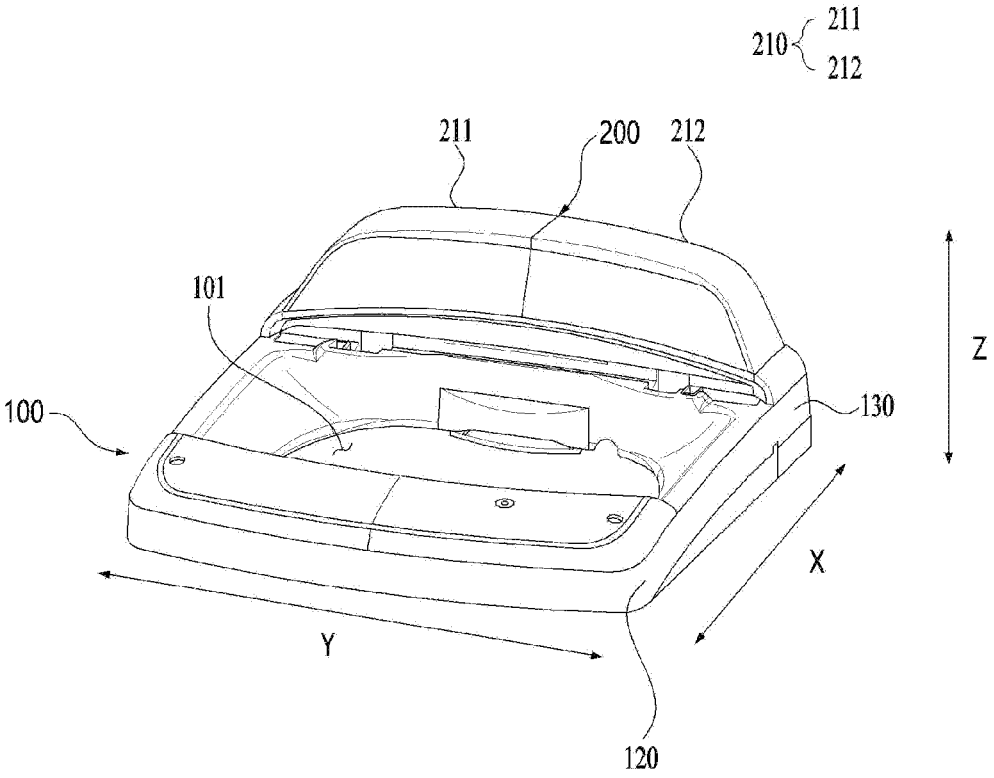

[Figure 5]
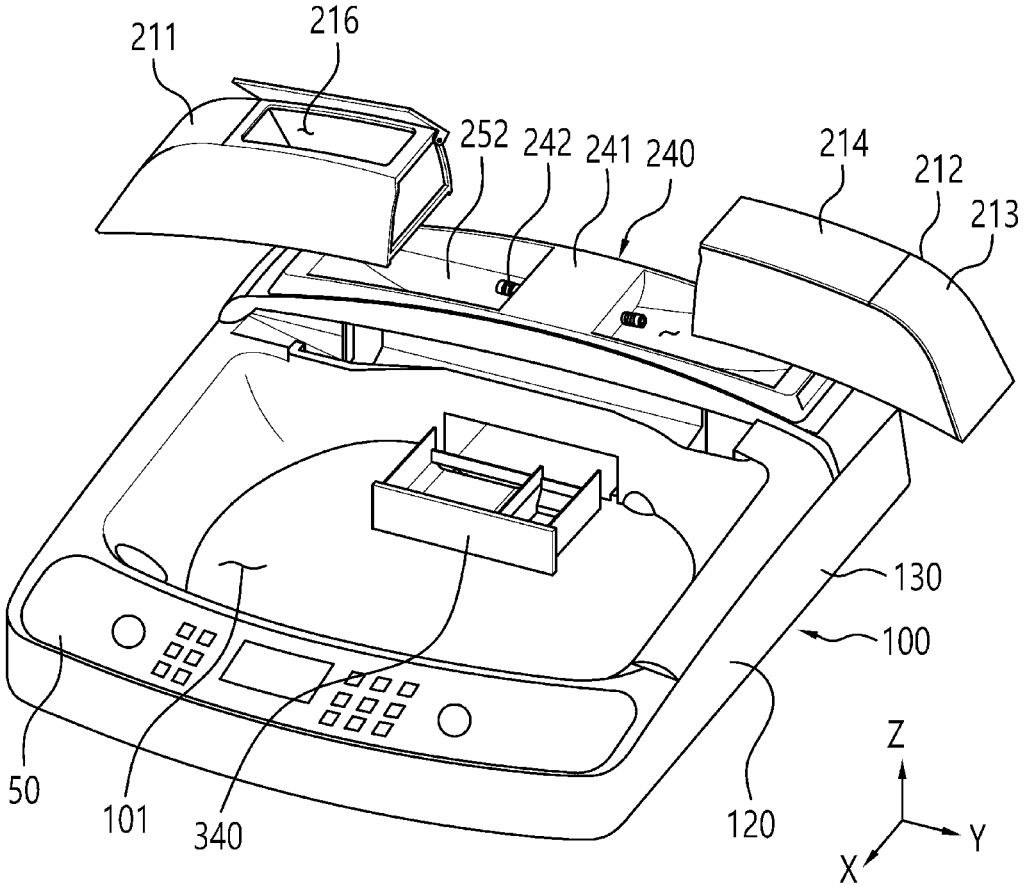

【Figure 6】
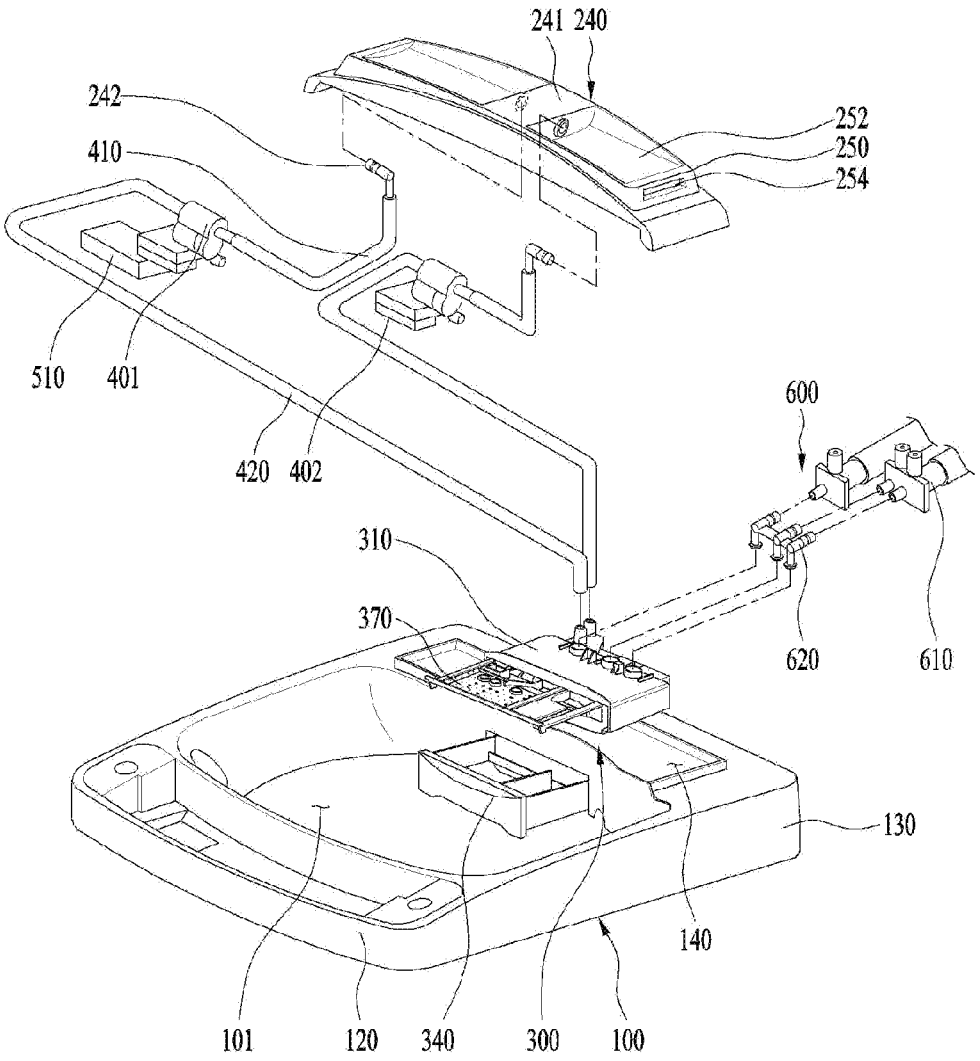

[Figure 7]
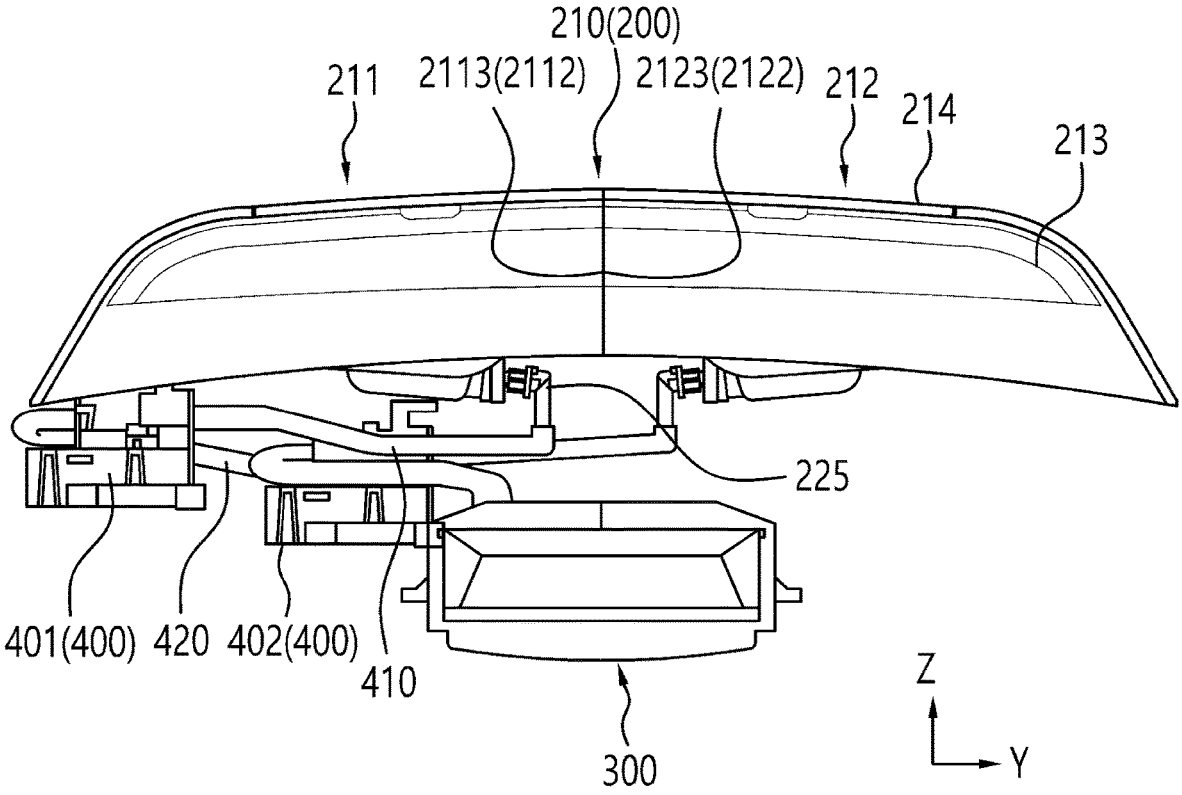

【Figure 8】
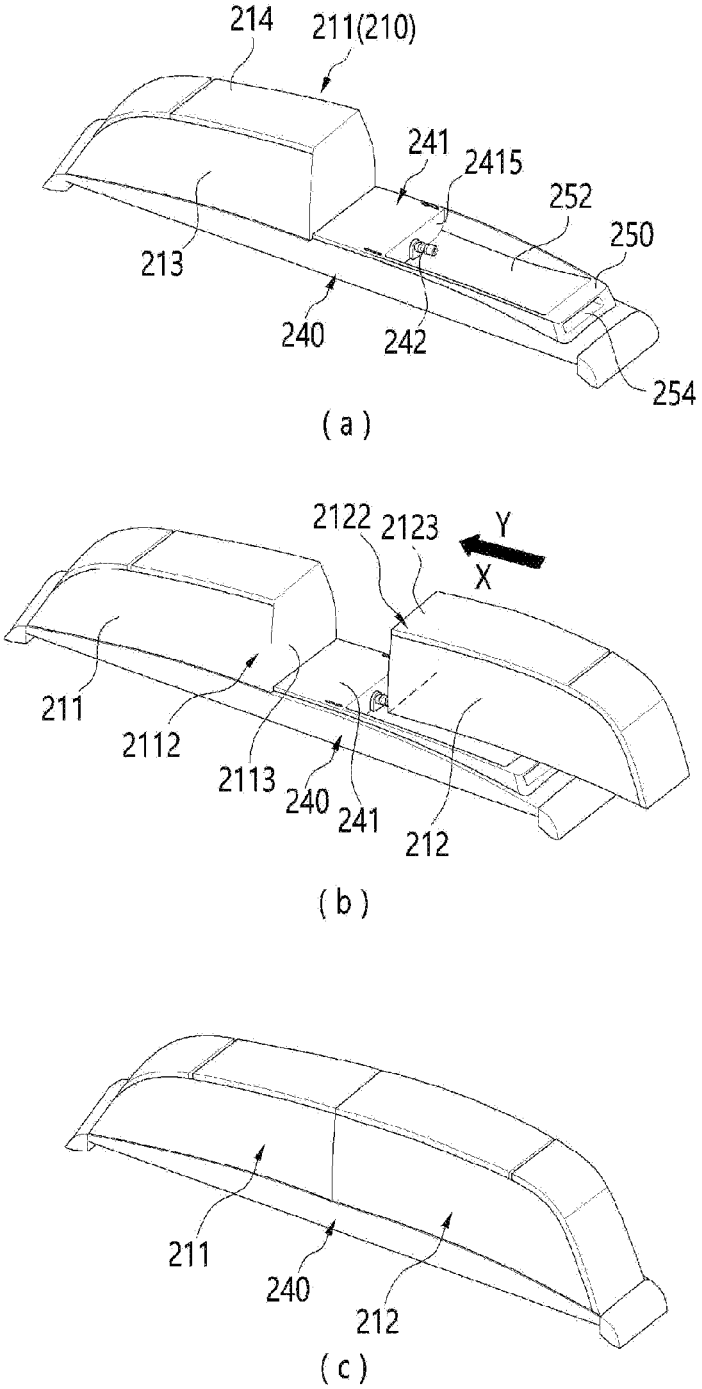

【Figure 9】
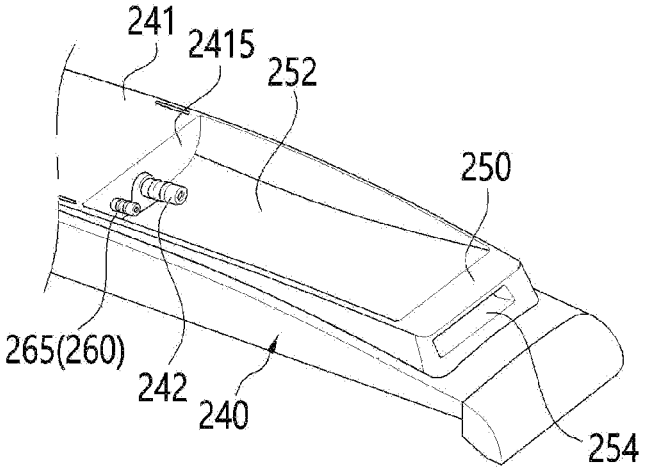
【Figure 10】
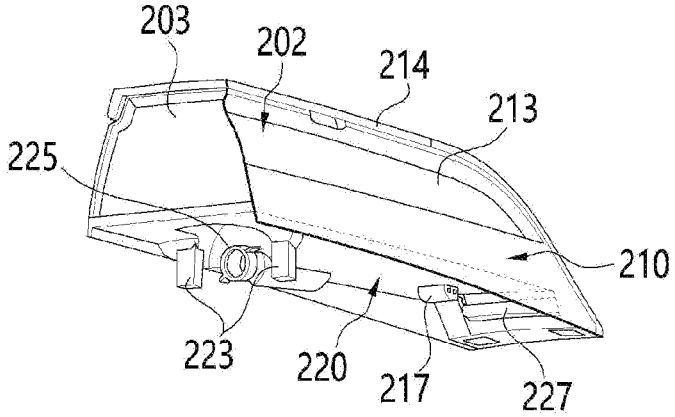

【Figure 11】
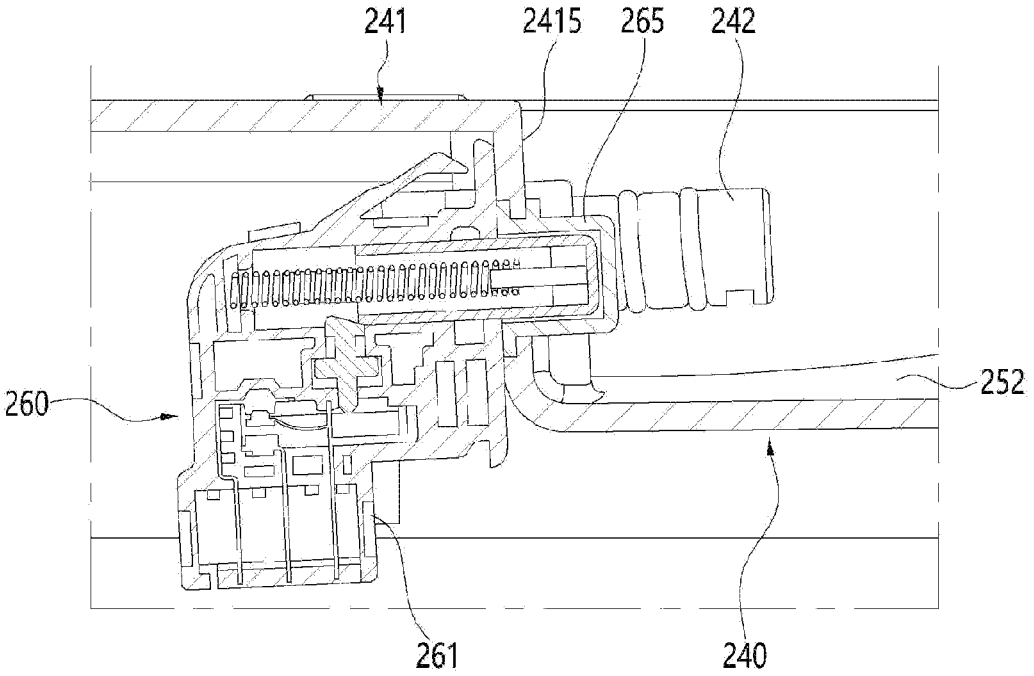

【Figure 12】
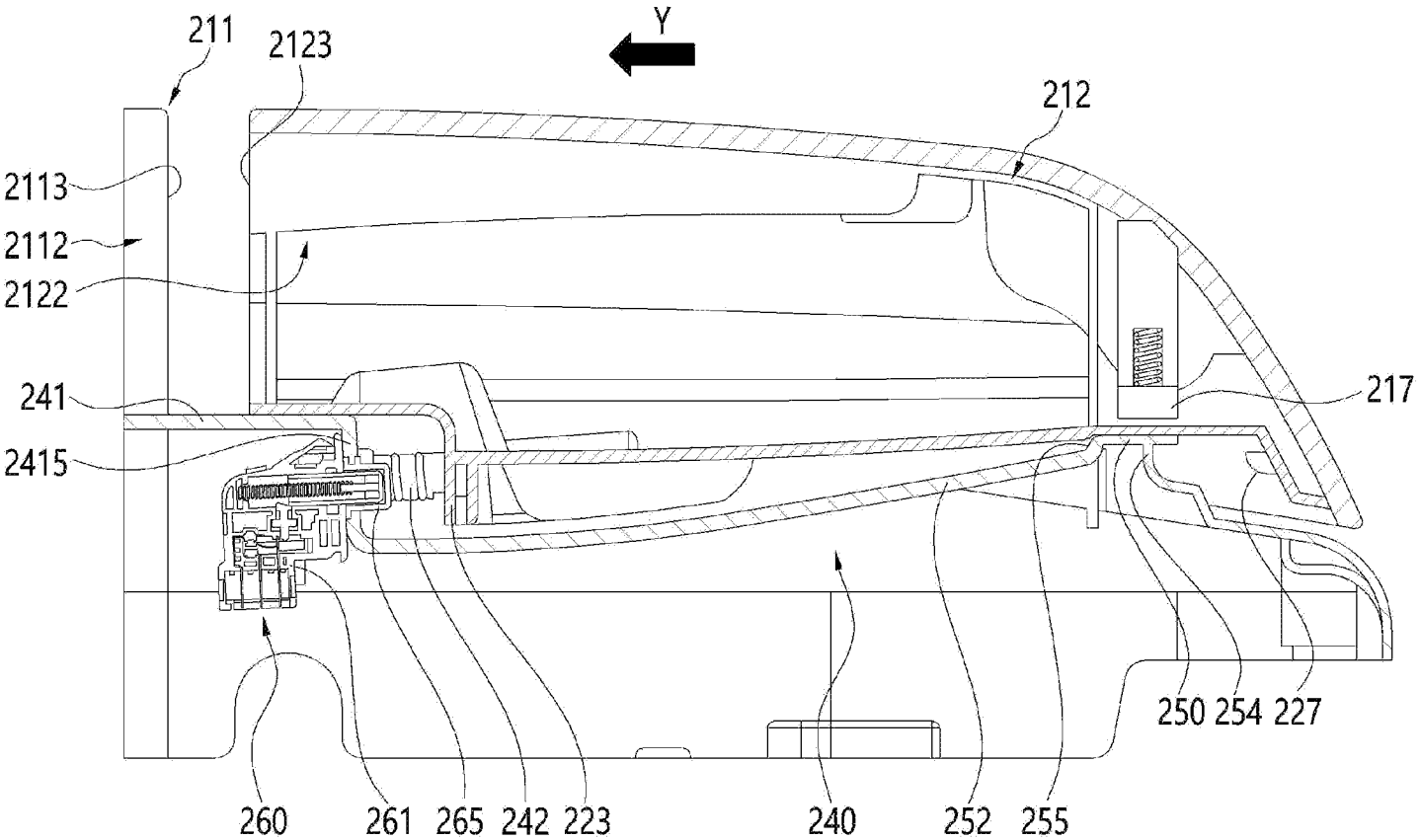

【Figure 13】
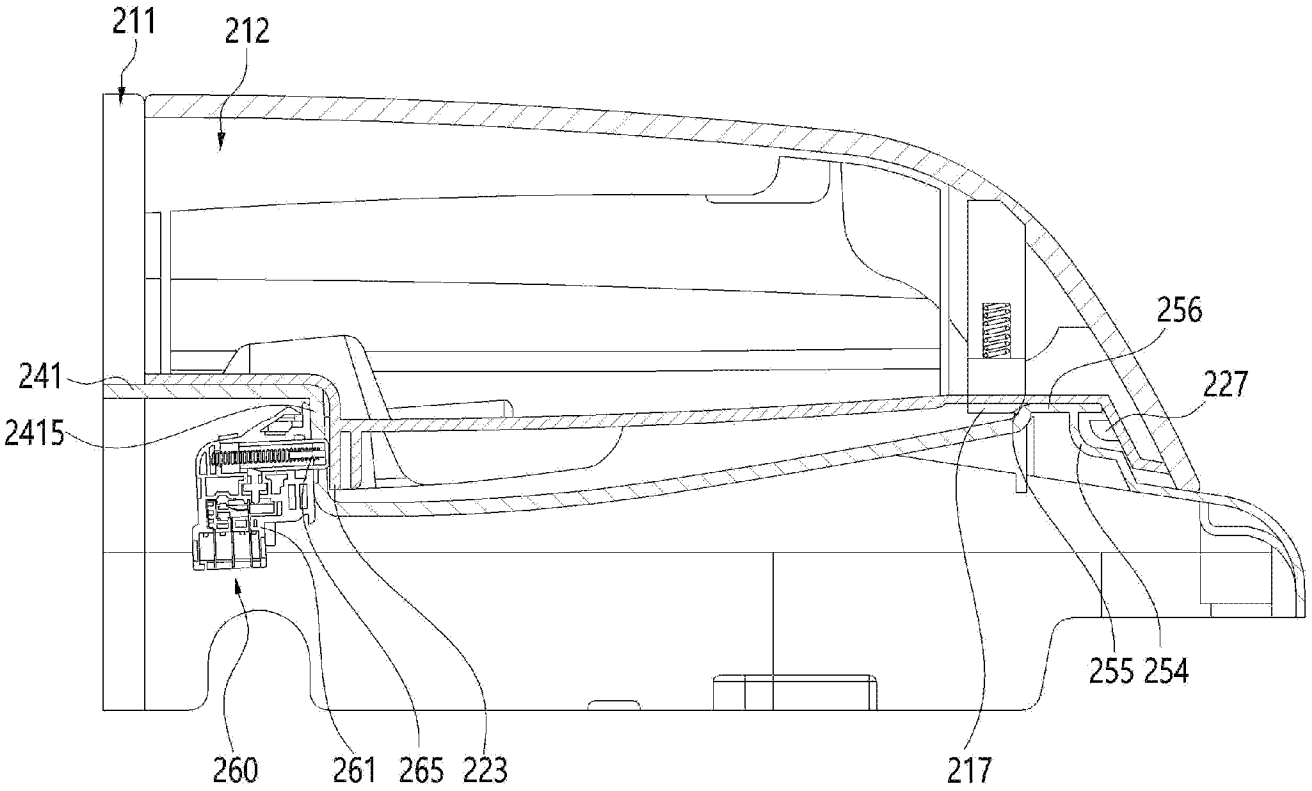

【Figure 14】
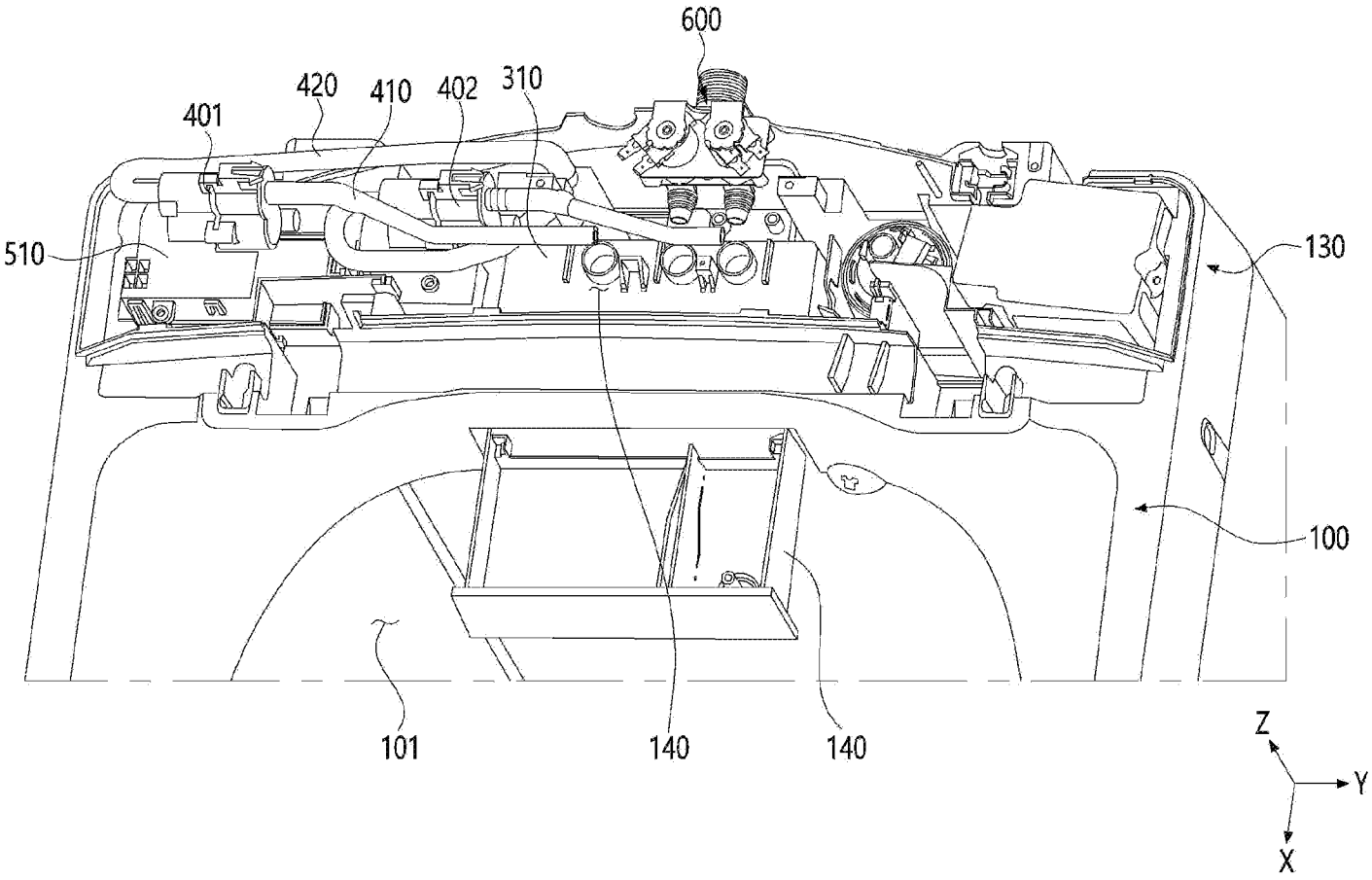

LAUNDRY TREATMENT APPARATUS

CROSS REFERENCE TO RELATED APPLICATIONS

This application is the National Phase of PCT International Application No. PCT/KR2022/020090, filed on Dec. 12, 2022, which claims priority under 35 U.S.C. 119(a) to Patent Application No. 10-2022-0171923, filed in the Republic of Korea on Dec. 9, 2022, all of which are hereby expressly incorporated by reference into the present application.

TECHNICAL FIELD

The present disclosure relates to a laundry treatment apparatus, and more particularly to a laundry treatment apparatus including a storage adapted to store detergent therein.

BACKGROUND ART

A laundry treatment apparatus is an apparatus capable of performing a washing course of eliminating contaminants from clothes, bedclothes and the like (referred to hereinafter as a laundry) introduced into a drum. The laundry treatment apparatus is capable of performing a rinsing course, a dewatering course, a spin-drying course and the like, in addition to the washing course.

The laundry treatment apparatus may include a cabinet defining the appearance of the apparatus, and a drum rotatably provided in the tub so as to receive laundry therein.

The laundry treatment apparatus may include a detergent supply adapted to introduce detergent into the tub or the drum in order to perform the washing course and the like. When the drum rotates in the state in which washing water and detergent are supplied to the inside of the tub, it is possible to eliminate contaminants from laundry by virtue of frictional action between the laundry and the drum, the washing water and the like.

The detergent supply may have a function of supplying detergent in order to enhance a washing effect. Here, the detergent may include all of materials capable of enhancing a washing effect, such as a laundry agent adapted to cause decomposition and separation of contaminants, a fabric softener adapted to enhance fabric softness of laundry and a bleaching agent adapted to improve color contamination of laundry. The detergent may include all of the form of flour (powder) and the form of liquid (liquid phase).

Korea unexamined patent publication No. 10-2020-0007549 discloses a laundry treatment apparatus including a conventional detergent supply. The conventional detergent supply includes a drawer configured to be drawn out of a cabinet, and a detergent path which is provided at the drawer to guide detergent to the tub. The above-mentioned conventional manual detergent supply is a type of detergent supply in which detergent introduced into the detergent path is supplied to the tub together with water.

However, because the conventional manual detergent supply is constructed such that a user directly introduces detergent before execution of every washing course, there is a difficulty in introducing a constant amount of detergent, and there is an inconvenience in that a user must introduce detergent every time.

In order to solve this problem, a detergent supply designed to automatically supply detergent during every washing course has been developed. Furthermore, a laundry treatment apparatus which is provided with the above-mentioned automatic detergent supply in addition to a conventional manual detergent supply so as to allow a user selectively to use one of the two detergent supplies has also been developed.

In the case in which an automatic detergent supply is additionally provided, there is a need to assure a space required to accommodate various components of the automatic detergent supply. However, a space for installation of the automatic detergent supply is limited in the laundry treatment apparatus, which is provided with the manual detergent supply and other components.

For example, considering user convenience in handling, although the automatic detergent supply may advantageously be disposed in an upper area of a cabinet, there may be a limitation on an installation space because a control panel and the like, which are manipulated by a user, is disposed at the upper portion of the cabinet.

Furthermore, in a top-loading laundry treatment apparatus in which an introduction opening through which laundry is introduced is provided on the upper surface of a cabinet, because the height of the upper end of a tub increases and an introduction opening for laundry and a door adapted to open and close the introduction opening are provided at the upper portion of the cabinet together with a control panel, compared to a front-loading type of laundry treatment apparatus in which an introduction opening is provided in the front surface of the cabinet, there may be tighter limitations on a space required for installation of the automatic detergent supply.

In order to solve such spatial limitations, a structure in which a storage container which requires a space for storage of detergent, among components of an automatic detergent supply, is exposed to the outside of the cabinet has been suggested.

Korea unexamined patent publication No. 10-2018-0080013 discloses a laundry treatment apparatus in which an automatic detergent supply including a detergent storage container which is exposed to the outside of the cabinet is installed.

The above-mentioned laundry treatment apparatus is constructed such that an automatic detergent supply is additionally provided to a conventional structure including a manual detergent supply and a detergent storage container adapted to store detergent therein is exposed to the outside of the cabinet for assurance of a space required for installation of the automatic detergent supply.

The detergent storage container may be exposed to the outside of the cabinet for efficient enlargement of a space, and may be removable from the cabinet for easy management.

In the case in which the detergent storage container is configured to be removable, it is important to determine whether or not the detergent storage container is mounted. For example, when the detergent storage container is removed while a washing course requiring supply of detergent is performed, a normal washing course may not be performed because detergent is not supplied to the inside of a tub.

Furthermore, in the case in which the detergent in the detergent storage container is caused to flow by a detergent pump, when the detergent pump is operated in the state in which the detergent storage container is removed, air and the like may be introduced into the detergent pump, thus causing damage of the detergent pump and the like.

Accordingly, in the case in which the detergent storage container adapted to store detergent therein is configured to be removed, to perform a laundry treatment procedure by determining whether or not the detergent storage container is mounted is an important task in the art.

DISCLOSURE

Technical Task

Embodiments of the present disclosure are intended to provide a laundry treatment apparatus capable of efficiently increasing a storage space for detergent.

Furthermore, embodiments of the present disclosure are intended to provide a laundry treatment apparatus in which a storage body is enlarged and exposed to the outside of a cabinet in order to increase an amount of detergent storage.

Furthermore, embodiments of the present disclosure are intended to provide a laundry treatment apparatus capable of allowing a storage body adapted to store detergent therein to be conveniently mounted and removed.

Furthermore, embodiments of the present disclosure are intended to provide a laundry treatment apparatus capable of efficiently determining whether or not a storage body is mounted.

Furthermore, embodiments of the present disclosure are intended to provide a laundry treatment apparatus capable of efficiently determining whether or not the storage body is stably mounted on an installation unit.

Technical Solutions

An embodiment of the present disclosure includes a storage adapted to store detergent therein, and the storage is provided with a storage body which stores detergent therein and which is removably mounted. The storage body may be moved in the width direction of a cabinet and may be mounted to or separated from an installation unit.

The installation unit is provided with a mount detector adapted to detect mounting of the storage body. The mount detector is pressed by the storage body mounted on the installation unit, thus detecting mounting of the storage body.

The mount detector may include a detecting protrusion which is pressed and moved by the storage body, and the detecting protrusion may be disposed parallel to a coupling pipe which is inserted into the storage body so as to allow detergent to flow therethrough. The detecting protrusion may project parallel to the coupling pipe to determine whether or not the coupling pipe is stably coupled to the storage body.

The laundry treatment apparatus according to an embodiment of the present disclosure includes a cabinet, a tub, and a storage. The cabinet includes a top cover equipped with an introduction opening. The tub is provided in the cabinet so as to store water therein, and includes a tub opening which faces the introduction opening.

The storage is provided at the top cover so as to store detergent therein, and is exposed at at least a portion thereof to the outside of the cabinet. The storage includes an installation unit, a storage body, and a mount detector. The installation unit is provided at the top cover, and communicates with the tub.

The storage body is exposed to the outside of the cabinet so as to store detergent therein, and is removably mounted on the installation unit in the width direction of the cabinet. The mount detector is provided at the installation unit, and is pressed by the storage body mounted on the installation unit, thus detecting mounting of the storage body.

The mount detector may include a detecting protrusion which projects from the installation unit in the width direction and is pressed by the storage body mounted on the installation unit.

The detecting protrusion may be pressed and moved in the width direction by the storage body. The mount detector may further include a detecting body disposed in the installation unit, and the detecting protrusion may project from the detecting body and may be exposed to the outside of the installation unit through the installation unit.

The installation unit may be provided with a central portion which projects upwards. At least a portion of the detecting body may be positioned in the central portion, and the detecting protrusion may extend through a side wall of the central portion.

The installation unit may further include a coupling pipe which is spaced apart from the mount detector, projects in the width direction, and is inserted into the storage body. The storage body may further include a detergent valve into which the coupling pipe is inserted in the width direction so as to allow the detergent to flow therethrough.

The installation unit may be provided with the central portion which projects upwards, and at least a portion of the mount detector and the coupling pipe may project from the central portion in the width direction.

The top cover may include a cover space defined below the installation unit, and the cover space may be provided therein with an outflow pipe which is connected to the coupling pipe and through which the detergent discharged from the storage body flows.

The storage body may include a pair of storage bodies, which slide toward each other on the installation unit and are coupled to the installation unit. The mount detector may include a plurality of mount detectors, some of which detect mounting of one of the pair of the storage bodies and a remaining one of which detects mounting of the other of the pair of storage bodies.

The installation unit may be provided in the center thereof with the central portion which projects upwards, and the pair of storage bodies may slide toward the central portion and may be mounted on the installation unit.

The some of the plurality of mount detectors may include a detecting protrusion which projects from the central portion to one side in the width direction, and the remaining one of the plurality of mount detectors may include a detecting protrusion which projects from the central portion to the opposite side in the width direction.

The pair of storage bodies may include facing surfaces which are positioned on the central portion so as to face each other and respectively press the detecting protrusions below the facing surfaces.

Each of the storage bodies may include a storage bottom portion which is positioned below the facing surface and defines the lower surface of the storage body. The storage bottom portion may be provided with a bottom damper which extends downwards to support the storage bottom portion with respect to the installation unit. The bottom damper may be positioned in the width direction of the central portion so as to press the detecting protrusion.

The top cover may include a cover space which is positioned below the installation unit. The cover space may be provided with a control module which is connected to the mount detector so as to receive the value of detection of the mount detector.

The cover space may be provided with a detergent pump which communicates with the storage body to pump the detergent, and the control module may be connected to the detergent pump to control operation of the detergent pump.

When the control module determines that the storage body is not mounted, based on the value of detection of the mount detector, the control module may halt operation of the detergent pump and may generated a signal requesting mounting of the storage body.

The storage body may include a plurality of storage bodies, and the detergent pump may include a plurality of detergent pumps which are respectively connected to the plurality of storage bodies. The plurality of detergent pumps may be aligned with each other in the cover space in the width direction. At least one of the plurality of detergent pumps may be disposed above the control module.

Advantageous Effects

Embodiments of the present disclosure are able to provide a laundry treatment apparatus capable of efficiently increasing a storage space for detergent.

Furthermore, embodiments of the present disclosure are able to provide a laundry treatment apparatus in which a storage body is enlarged and exposed to the outside of a cabinet in order to increase an amount of detergent storage.

Furthermore, embodiments of the present disclosure are able to provide a laundry treatment apparatus capable of allowing a storage body adapted to store detergent therein to be conveniently mounted and removed.

Furthermore, embodiments of the present disclosure are able to provide a laundry treatment apparatus capable of efficiently determining whether or not a storage body is mounted.

Furthermore, embodiments of the present disclosure are able to provide a laundry treatment apparatus capable of efficiently determining whether or not the storage body is stably mounted on an installation unit.

DESCRIPTION OF DRAWINGS

FIG. 1 is a perspective view illustrating the laundry treatment apparatus according to an embodiment of the present disclosure;

FIG. 2 is a perspective view illustrating the laundry treatment apparatus shown in FIG. 1 in which an introduction opening is open;

FIG. 3 is a cross-sectional view illustrating the interior of the laundry treatment apparatus according to an embodiment of the present disclosure;

FIG. 4 is a view illustrating a top cover of the laundry treatment apparatus according to an embodiment of the present disclosure;

FIG. 5 is a view illustrating the storage body and the installation unit, which are provided at the top cover, according to an embodiment of the present disclosure;

FIG. 6 is a view illustrating a detergent passage of the storage according to an embodiment of the present disclosure;

FIG. 7 is a view illustrating the connection relationships between the storage body and a detergent pump according to an embodiment of the present disclosure;

FIG. 8 is a view illustrating a procedure of mounting the storage body on the installation unit, according to an embodiment of the present disclosure;

FIG. 9 is a view illustrating a seating surface of the installation unit according to an embodiment of the present disclosure;

FIG. 10 is a view illustrating a storage bottom portion of the storage body according to an embodiment of the present disclosure;

FIG. 11 is a view illustrating a mount detector provided at the installation unit, according to an embodiment of the present disclosure;

FIG. 12 is a view illustrating the state in which the storage body is mounted on the installation unit, according to an embodiment of the present disclosure;

FIG. 13 is a view illustrating the state in which the storage body is completely mounted on the installation unit, according to an embodiment of the present disclosure; and FIG. 14 is a view illustrating a rear space in a top cover according to an embodiment of the present disclosure.

BEST MODE FOR DISCLOSURE

Hereinafter, with reference to the accompanying drawings, embodiments of the present disclosure will be described in detail so that those skilled in the art can easily implement the present disclosure.

However, the present disclosure may be implemented in several different forms and is not limited to the embodiments described herein. In order to clearly illustrate the present disclosure, components not related to the description are omitted, and similar components are denoted by like reference numerals throughout the specification.

In this specification, redundant descriptions of the same components are omitted.

It will be understood that, when an element is referred to as being "connected" or "coupled" to another element, the element can be directly connected or coupled to the other element and an intervening element may also be present therebetween. In contrast, in this specification, it will be understood that, when an element is referred to as being "directly connected" or "directly coupled" to another element, there are no intervening elements present therebetween.

The terminology used herein is merely for the purpose of describing particular embodiments, and is not intended to limit the scope of the present disclosure.

In addition, as used herein, a singular form may encompass the plural form unless context dictates otherwise.

In this specification, it will be further understood that the terms "comprise", "have", etc., specify the presence of stated features, integers, steps, operations, elements, components, or combinations thereof, but do not preclude the presence or addition of one or more other features, integers, steps, operations, elements, components, or combinations thereof.

Furthermore, in this specification, the term "and/or" includes a combination of a plurality of related listed items or any of the plurality of related listed items. In this specification, "A or B" may include "A", "B", or "both A and B.".

FIG. 1 illustrates a laundry treatment apparatus 1 according to an embodiment of the present disclosure. FIG. 2 illustrates the state in which a door 110 of the laundry treatment apparatus 1 is rotated to open an introduction opening 101.

Referring to FIGS. 1 and 2, an embodiment of the present disclosure includes a cabinet 10. The cabinet 10 may define the appearance of the laundry treatment apparatus 1, and may define therein a space in which a tub 20 and a drum 30, which will be described later, are accommodated.

The cabinet 10 may include a cabinet body 15, which has the form of an approximate hexahedron and has a space adapted to accommodate the tub 20, the drum 30 and the like, and a top cover 100 adapted to cover the upper open surface of the cabinet body 15.

The cabinet body 15 may include a plurality of panels. For example, the cabinet body 15 may include at least one of a front panel, a rear panel, a side panel, and a lower panel.

The cabinet body 15 may be constructed so as to be open at the upper surface thereof, and the top cover 100 may be disposed on the upper open surface. The top cover 100 may be coupled to the cabinet body 15 to define the cabinet 10.

Here, the cabinet 10 may include the top cover 100 equipped with the introduction opening 101. In other words, the introduction opening 101 may be formed in the top cover 100 so as to allow laundry to be introduced thereinto. Specifically, an embodiment of the present disclosure may be a top-loading laundry treatment apparatus 1 in which the introduction opening 101 is open upwards and the rotational axis of the drum 30 is perpendicular to the ground surface. However, an embodiment of the present disclosure is not necessarily limited to the top-loading laundry treatment apparatus.

The introduction opening 101 may be an opening formed through the top cover 100, and may be in communication with the inside of the cabinet 10. A user may introduce laundry into the cabinet 10 through the introduction opening 101. The door 110 may be rotatably coupled to the top cover 100, and the door 110 may open and close the introduction opening 101 according to a rotated state thereof.

The top cover 100 may include a front portion 120 and a rear portion 130. The front portion 120 may be defined in the front of the door 110, and the rear portion 130 may be defined in the rear of the door 110.

The front portion 120 of the top cover 100 may be provided with a control panel 50. The control panel 50 may include an output unit adapted to provide a user with information in various manners, and an input unit adapted to receive command inputs from a user in various manners.

The rear portion 130 of the top cover 100 may be provided with a storage 200. The storage 200 may be provided at the top cover 100 so as to be exposed to the outside at at least a portion thereof. Furthermore, the storage 200 may include a space adapted to store detergent therein.

The storage 200 may be constructed so as to project upwards from the top cover 100 at at least a portion thereof. Consequently, it is possible to efficiently assure a space adapted to store detergent. Although FIGS. 1 and 2 illustrate the storage 200, which projects upwards from the top cover 100, the direction in which the storage 200 projects is not necessarily limited to the upward direction.

The storage 200 may be an automatic detergent supply device. In other words, the storage 200 may be designed to supply a predetermined amount of detergent that is previously stored by a user, to the tub 20 during every washing course.

For convenience in use of the storage 200, it is important to assure a detergent storage capacity of the storage 200. An embodiment of the present disclosure is able to efficiently increase the space adapted to store detergent by projecting the storage 200 outwards from the top cover 100.

Here, the storage 200 may include an installation unit 240 and a storage body 210, which will be described later. The storage body 210 may include a space adapted to store detergent therein, and may be detachable from the installation unit 240.

The storage body 210 may be moved in a direction parallel to the ground surface and be detachably mounted on the installation unit 240 so as to efficiently increase a fixing force with respect to the installation unit 240.

When the storage body 210 is coupled to the installation unit 240 in a direction perpendicular to the ground surface, it may be liable to be subjected to a separation phenomenon of the storage body 210 caused by vibration or the like of the laundry treatment apparatus 1, and the depth to which the storage body 210 is inserted may increase in order to stably secure the storage body 210.

Accordingly, according to an embodiment of the present disclosure, it is possible to efficiently decrease the depth to which the storage body 210 is inserted by allowing the storage body 210 to be moved parallel to the ground surface, and is possible to stably secure the storage body 210 by virtue of sliding coupling or the like.

Furthermore, according to an embodiment of the present disclosure, the storage body 210 may be moved in the width direction Y of the cabinet 10 so as to prevent interference with operation of the door 110 which is disposed in front thereof. In other words, the storage body 210 may be moved in the width direction Y and then be coupled to or separated from the installation unit 240.

Meanwhile, FIG. 3 illustrates the interior of the laundry treatment apparatus 1 according to an embodiment of the present disclosure.

Referring to FIG. 3, the cabinet 10 may be provided therein with the tub 20 and the drum 30. The tub 20 may receive water therein, and may include a tub opening 22 which is open toward the introduction opening 101.

According to an embodiment of the present disclosure, the introduction opening 101 may be located at the top cover 100, and the tub opening 22 in the tub 20 may also be open upwards. In other words, the laundry treatment apparatus 1 according to the present disclosure may be a top-loading type in which the axis of the laundry treatment apparatus 1 is perpendicular to the ground surface.

The drum 30 may be provided in the tub 20. The drum 30 may be rotatably provided in the tub 20, and may receive laundry therein. The drum 30 may include a drum opening 32 which is open toward the introduction opening 101.

Accordingly, laundry, which is introduced through the introduction opening 101, may be received in the drum 30 through the tub opening 22 and the drum opening 32. The tub 20 and the drum 30 may each have the form of a cylinder having an internal space, and the drum 30 may be provided in the peripheral surface thereof with a plurality of communication holes 31.

When water is stored in the tub 20, the drum 30 may share the water with the tub 20 because the water in the tub 20 is introduced into the drum 30 through the communication holes 31.

According to an embodiment of the present disclosure, the upper portion of the cabinet 10, that is, the top cover 100 may be provided with the storage 200 and an internal storage 300. The top cover 100 may have a cover space which is formed in the rear portion 130 positioned behind the door 110. The cover space may be defined as a portion of the internal space in the cabinet 10.

The top cover 100 may be open such that the cover space is exposed upwards, and the storage 200 may include the installation unit 240 which is provided to cover the open surface of the cover space. The storage 200 may include the storage body 210 in which detergent is stored, and the storage body 210 may be mounted on the installation unit 240 above the top cover 100.

The internal storage 300 may be positioned in the cover space. According to an embodiment of the present disclosure, the storage 200 may be configured such that the detergent in the storage 200 is supplied to the tub 20 through the internal storage 300, or may be in communication with the tub 20 independent of the internal storage 300.

The internal storage 300 may receive detergent independent of the storage 200 provided in the top cover 100. The internal storage 300 may be formed through the peripheral surface around the introduction opening 101 in the top cover 100.

The internal storage 300 may be in communication with the inside of the tub 20 through the introduction opening 101. When the internal storage 300 is in communication with the storage 200, the detergent stored in the storage 200 may be transferred to the internal storage 300, and the internal storage 300 may supply the detergent stored therein together with the detergent transferred from the storage 200, to the inside of the tub 20.

An embodiment of the present disclosure may include a water supply 600 connected to an external water supply source outside the cabinet 10. The water supply 600 may be in communication with the tub 20 so as to supply water to the tub 20. The water supply 600 may be directly connected to the tub 20, or may be connected to the internal storage 300 so as to supply water to the tub 20 through the internal storage 300.

An embodiment of the present disclosure may include a drive 40 and a pulsator 35. The drive 40 may be positioned under the tub 20, and may be connected to the drum 30 via a drive shaft passing through the tub 20. In other words, the drum 30 may be positioned in the tub 20, and may receive rotative force from the drive 40 via the drive shaft.

The drum 30 may be provided on the bottom thereof with a rotating unit. The rotating unit may be provided so as to cover at least a portion of the bottom surface of the drum 30 from above, and may rotate in conjunction with or independently of the drum 30.

The rotating unit may be connected to the drive 40. The drive 40 may include a transmission and the like, and the drive shaft may include a solid shaft and a hollow shaft which are connected to the transmission. One of the solid shaft and the hollow shaft may be connected to the drum, and the other of the solid shaft and the hollow shaft may be connected to the rotating unit.

The cabinet 10 may be provided therein with a suspension 25 adapted to support the tub 20 by the cabinet 10. The suspension 25 may include an elastic body and the like in order to reduce vibration transmitted from the tub 20.

Accordingly, since the vibration, which is generated by the drum 30 or the drive 40 and is transmitted via the tub 20, is reduced by virtue of the suspension 25, it is possible to reduce an amount of vibration transmitted to the cabinet 10.

Furthermore, a water discharge 700 may be connected to the tub 20. Consequently, washing water containing contaminants generated during washing course may be discharged to the outside of the cabinet 10 from the tub 20 through the water discharge 700.

Meanwhile, FIG. 4 illustrates the top cover 100 according to an embodiment of the present disclosure which is provided with the storage body 210 and a drawer 340 of the internal storage 300. FIG. 5 illustrates the state in which the storage body 210 and the drawer 340 are separated from the top cover 100 shown in FIG. 4.

Referring to FIGS. 4 and 5, according to an embodiment of the present disclosure, the top cover 100 may include the storage 200 and the internal storage 300. When the internal storage 300 is included, the storage 200 including the storage body 210 may also be defined as an external storage 200.

The internal storage 300 may be provided in the cabinet 10 so as to be shielded by the outside, and the storage body 210 included in the storage 200 may be exposed to the outside so as to allow a user to see the storage body 210 and the like with the naked eyes from the outside.

The control panel 50 may be positioned at the front portion 120 of the top cover 100, and the storage 200 and the internal storage 300 may be provided at the rear portion 130. The storage 200 may be disposed above a rear space, and the internal storage 300 may be disposed in the rear space.

The storage 200 may include the installation unit 240 and the storage body 210, and the installation unit 240 may be provided at the top cover 100 so as to communicate with the tub 20. The storage body 210 may be detachably coupled to the installation unit 240, and may store detergent therein.

The installation unit 240 may be provided at the top cover 100, and may be coupled to the top cover so as to define a portion of the appearance of the top cover 100. The top cover 100 may include the rear space, which has previously been described, and the installation unit 240 may be provided so as to cover the open surface of the rear space. Here, the installation unit 240 may be defined as a portion of the top cover 100.

The storage body 210 may be configured to project upwards from the top cover 100, and may be separated from the installation unit 240. The storage body 210 may include a storage main body 213 adapted to store detergent therein. The storage main body 213 may include a detergent introduction opening 216 through which detergent is introduced by a user.

The storage main body 213 may be provided with a storage cap 214. The storage cap 214 may be rotatably provided at the storage main body 213, and may open and close the detergent introduction opening 216 depending on a rotated state thereof.

A user may separate the storage body 210 from the installation unit 240 for washing or introduction of detergent. However, washing and introduction of detergent may also be performed even in the state in which the storage body 210 is coupled to the installation unit 240.

The installation unit 240 may be provided with a seating surface 252 on which the storage body 210 is seated. The storage body 210 may be positioned on the seating surface 252 so as to be coupled to the installation unit 240. The installation unit 240 may include a coupling pipe 242, which is inserted into the storage body 210 so as to communicate with the inside of the storage body 210.

When the storage body 210 is coupled to the installation unit 240, the coupling pipe 242 may be inserted into the storage body 210 so as to constitute a portion of a passage through which detergent flows.

According to an embodiment of the present disclosure, the storage body 210 of the storage 200 may include a plurality of storage bodies. For example, the storage body 210 may include a plurality of storage bodies, that is, a first storage body 211 and a second storage body 212.

All of the first storage body 211 and the second storage body 212 may be detachably coupled to the installation unit 240. The installation unit 240 may include a plurality of seating surfaces 252 on which the first storage body 211 and the second storage body 212 are respectively seated.

The first storage body 211 and the second storage body 212 may include different spaces adapted to store detergent. Thus, different kinds of detergent may be stored in the first storage body 211 and the second storage body 212. The first storage body 211 and the second storage body 212 may include the detergent introduction opening 216 and the storage cap 214, respectively.

The installation unit 240 may include a central portion 241, which is disposed in the approximate center in the width direction Y of the cabinet 10. The central portion 241 may be configured to project upwards with respect to the seating surface 252.

Seating surfaces may be disposed at opposite sides of the central portion 241 in the width direction Y. Consequently, the first storage body 211 and the second storage body 212 may respectively be positioned at opposite sides of the central portion of the installation unit 240. According to an embodiment of the present disclosure, a plurality of storage bodies 210 including the first storage body 211 and the second storage body 212 may be aligned with each other in the width direction Y of the cabinet 10.

The plurality of storage bodies 210 may be aligned with each other in the direction in which the storage bodies 210 are coupled. Specifically, the plurality of storage bodies 210 may be coupled to and separated from the installation unit 240 in the width direction Y of the cabinet 10, and may disposed in a line in the width direction Y.

The central portion 241 may serve as a stopper adapted to limit the distance that the first storage body 211 and the second storage body 212 are moved so as to be coupled in the width direction Y. For example, the first storage body 211 and the second storage body 212 may be moved to the central portion 241 from opposite sides of the central portion 241 in the width direction Y, and may be brought into contact with the central portion 241 and be coupled to the installation unit 240.

Here, portions of the first storage body 211 and the second storage body 212 may be disposed on the central portion 241 and be supported thereby, and the remaining portions of the storage body 211 and the second storage body 212 may be disposed on the seating surface 252 and be supported thereby.

The internal storage 300 may include the drawer 340. The drawer 340 may be drawn out of the rear space or be put into the rear space. A user may introduce detergent into the drawer 340, and may then put the drawer 340 storing the detergent into the rear space.

A portion of the peripheral surface of the top cover 100 around the introduction opening may be open, and thus the drawer 340 may be put into and drawn out of the rear space through the portion of the peripheral surface around the introduction opening.

Meanwhile, FIG. 6 illustrates a passage, which is defined by coupling the installation unit 240 and through which detergent flows. FIG. 7 illustrates the storage body 210 and the internal storage 300, which are connected to each other via the passage.

Referring to FIGS. 6 and 7, the installation unit 240 may include the coupling pipe 242 connected to the storage body 210 coupled to the installation unit 240, and an outflow pipe 410 connected to the coupling pipe 242.

The detergent stored in the storage body 210 may be discharged and flow from the storage body 210 through the coupling pipe 242 and the outflow pipe 410. The outflow pipe 410 may connect the coupling pipe 242 to a detergent pump 400. In other words, the detergent discharged from the storage body 210 may be supplied to the detergent pump 400 through the outflow pipe 410.

The detergent pump 400 may be configured to pump the detergent stored in the storage body 210. Similar to the storage body 210, the detergent pump 400 may include a plurality of detergent pumps. For example, the plurality of detergent pumps 400 may include a first detergent pump 401 connected to the first storage body 211 and a second detergent pump 402 connected to the second storage body 212.

The detergent pump 400 may be provided in the rear space in the top cover 100. Consequently, the plurality of detergent pumps 400 may be shielded from the outside, and may be aligned with each other in the width direction Y of cabinet 10.

Furthermore, an embodiment of the present disclosure may include a pump control module 510, which is connected to the plurality of detergent pumps 400 so as to control operation of the plurality of detergent pumps 400.

The pump control module 510 may control the detergent pump 400 according to a preset standard to supply a certain amount of detergent to the tub 20 during execution of washing course. The pump control module 510 may be connected to a main control module or the control panel 50 of the front portion 120 via an electrical wire extending along the side lateral portion of the top cover 100.

Each of the coupling pipe 242 and the outflow pipe 410 may be composed of a pair, and may be connected to one of the first storage body 211 and the second storage body 212. The coupling pipes 242 may project from the central portion 241 in the width direction Y of the cabinet 10.

One of the coupling pipes 242 may project in one direction of the width direction Y from the central portion 241, and the other of the coupling pipes 242 may project in the opposite direction of the width direction Y from the central portion 241. The first storage body 211 and the second storage body 212 may be moved toward the central portion 241 from opposite sides of the width direction Y, and may then be coupled to the installation unit 240.

The first storage body 211 may include a facing end 2112 and a facing surface 2113 disposed on the facing end 2112, and the second storage body 212 may include a facing end 2122 and a facing surface 2123, which face the first storage body 211.

The facing end 2112 and the facing surface 2113 of the first storage body 211 may be disposed so as to face the second storage body 212, and the facing end 2122 and the facing surface 2123 of the second storage body 212 may be disposed so as to face the first storage body 211.

The facing end 2112 of the first storage body 211 and the facing end 2122 of the second storage body 212 may be positioned on the central portion 241, and may be supported by the central portion 241. The facing surface 2113 of the first storage body 211 and the facing surface 2123 of the second storage body 212 may be disposed on the central portion 241 so as to face each other.

The detergent pump 400 may be connected to the internal storage 300 via a detergent pipe 420. In other words, detergent outflowing from the storage body 210 may be supplied to the internal storage 300 via the coupling pipe 242, the outflow pipe 410, the detergent pump 400, and the detergent pipe 420. The internal storage 300 may include a receiving case 310 disposed in the rear space of the top cover 100, and the detergent pipe 420 may connect the detergent pump 400 and the receiving case 310 to each other.

Consequently, the detergent stored in the storage body 210 may be transferred to the internal storage 300. The receiving case 310 of the internal storage 300 may be configured to receive the drawer 340 in which detergent is stored.

The rear portion 130 of the top cover 100 may be provided with the water supply 600. The water supply 600 may include a water supply valve 610 adapted to intermit or allow flow of water, and a water supply pipe 620 through which water flows. The water supply pipe 620 may connect the water supply valve 610 to the receiving case 310 of the internal storage 300.

The receiving case 310 may include therein a water diffuser 370 adapted to increase a diffusing area of water transferred from the water supply 600. The drawer 340 may be positioned below the water diffuser 370 in the receiving case 310 such that the water transferred through the water diffuser 370 is supplied to the drawer 340.

The receiving case 310 may be open toward the introduction opening 101, and the water supplied to the receiving case 310 and the detergent in the storage body 210 may be discharged to the introduction opening 101 together with the detergent in the drawer 340, and may thus be supplied to the inside of the tub 20.

FIG. 8 illustrates a procedure of mounting the storage body 210 on the installation unit 240, according to an embodiment of the present disclosure. Although FIG. 8 illustrates a procedure of mounting the second storage body 212 in the state in which the first storage body 211 has been previously mounted, the procedure is not limited to the second storage body 212, and the second storage body 212 is representative of the storage body 210.

Referring to (a) of FIG. 8, the installation unit 240 may be provided with the central portion 241, the seating surface 252, and a projection 250. The central portion 241 of the installation unit 240 may be disposed in the center of the installation unit 240 in the width direction Y, and the facing end 202 of the storage body 210 may be disposed on the central portion 241.

The seating surface 252 may serve as a surface on which the storage body 210 to be mounted on the installation unit 240 is seated. The seating surface 252 may be provided with the coupling pipe 242 which is coupled to the storage body 210. The detergent in the storage body 210 may be discharged to the outside of the storage body 210 through the coupling pipe 242.

The projection 250 may be positioned at an outer side of the seating surface in the width direction Y. The seating surface 252 may be positioned between the central portion 241 and the projection 250. The central portion 241 may be positioned at an inner side of the seating surface 252 in the width direction Y.

The projection 250 may serve as a portion to which the storage body 210 is fixed. The projection 250 may be provided with a hook groove 254 into which a hook protrusion 227 provided at the storage body 210 is inserted and fixed. A variable protrusion 217 of the storage body 210 may be disposed at an inner side of the projection 250 in the width direction Y of the cabinet 10, and a protrusion support surface 255 (FIG. 12), which is to be brought into contact with the variable protrusion 217 in the width direction Y, may be positioned on the inner surface of the projection 250.

Referring to (b) of FIG. 8, the storage body 210 may slide toward the central portion 241 in the state of being placed on the installation unit 240. The storage body 210 may be moved in one direction and may then be coupled to the installation unit 240. Here, the one direction may be the width direction Y of the cabinet 10.

The storage body 210 may be moved to an inner side of the installation unit 240 in the width direction Y. The storage body 210 may be moved toward the center of the installation unit 240. The first storage body 211 may be moved toward the second storage body 212, and the second storage body 212 may be moved toward the first storage body 211. The coupling direction of the first storage body 211 and the coupling direction of the second storage body 212 may be opposite to each other.

In the course of coupling the storage body 210, the facing end 2112 of the first storage body 211 and the facing end 2122 of the second storage body 212 may be moved close to each other. The facing surface 2113 of the first storage body 211 and the facing surface 2123 of the second storage body 212 may be moved close to each other while facing each other.

Referring to (c) of FIG. 8, the storage body 210 may be moved so as to come into contact with the central portion 241, and may then be completely coupled to the installation unit 240. The coupling pipe 242 of the installation unit 240 may be inserted into the storage body 210. The central portion 241 of the installation unit 240 may limit the movement range of the storage body 210.

According to an embodiment of the present disclosure, the storage body 210 may slide on the installation unit 240, and may then be coupled to the installation unit 240. The storage body 210 may be moved in the width direction Y of the cabinet 10, and the installation unit 240 may have a shape which extends in the width direction Y.

The storage body 210 may be moved along the seating surface 252, and the coupling of the storage body 210 may be terminated when the facing end 202 is positioned at the central portion 241. The storage body 210 may be immovable in the forward and backward direction X, the width direction Y, and the upward and downward direction Z by means of the coupling pipe 242, the variable protrusion 217, the hook protrusion 227, the bottom side wall and the like.

FIG. 9 is a view illustrating the installation unit 240 according to an embodiment of the present disclosure. According to an embodiment of the present disclosure, the storage 200 may be provided at the top cover 100 so as to store detergent therein, and may be exposed at at least a portion thereof to the outside of the cabinet 10.

The storage 200 may include the installation unit 240, which is provided at the top cover 100 and communicates with the tub 20, and the storage body 210, which is exposed to the outside of the cabinet 10 and stores detergent therein and which is removably mounted on the installation unit 240 in the width direction Y of the cabinet 10.

The installation unit 240 may include the central portion 241, the seating surface 252, and the projection 250. The central portion 241 may be disposed in the approximate center of the installation unit 240 in the width direction Y. The central portion 242 may be configured so as to project upwards higher than the seating surface 252.

The central portion 241 may limit the movement range of the storage body 210, which slides toward the center of the installation unit 240. For example, because the storage body 210 slides toward the center of the installation unit 240 and comes into contact with the central portion 242 which projects upwards, further movement of the storage body 210 toward the center of the installation unit 240 may be limited.

The seating surface 252 may extend from the central portion 241 in the width direction Y of the cabinet 10. The seating surface 252 may be positioned lower than the upper surface of the central portion 241. The seating surface 252 may be an area in which the storage body 210 coupled to the installation unit 240 is seated.

The seating surface 252 may be inclined downwards moving toward the central portion 241. At least a portion of the storage bottom portion 220 of the storage body 210 may be inclined downwards as the same approaches the central portion 241 so as to correspond to the seating surface 252.

The installation unit 240 may include the coupling pipe 242. The coupling pipe 242 may be inserted into the storage body 210 mounted on the installation unit 240. The coupling pipe 242 may project toward the storage body 210. The coupling pipe 242 may project parallel to the moving direction of the storage body 210. The coupling pipe 242 may extend in the width direction Y of the cabinet 10.

The coupling pipe 242 may project from the central portion 241. The central portion 241 may include a side wall 2415 connected to the seating surface 252, and the coupling pipe 242 may project from the side wall 2415 of the central portion 241.

The projection 250 of the installation unit 240 may project upwards higher than the seating surface 252. The projection 250 may be connected to the end of the seating surface 252. The central portion 241 may be disposed at one end of the projection, and the projection 250 may be disposed at the other end.

The seating surface 252 may have a shape which is concave downwards between the central portion 241 and the projection 250. The projection 250 may be coupled to the storage body 210. The inner surface of the projection 250 in the width direction Y may be provided with the protrusion support surface 255, which is brought into contact with the variable protrusion 217 of the storage body 210 in the width direction Y. The outer surface of the projection 250 in the width direction Y may be provided with the hook groove 254 into which the hook protrusion 227 is inserted in the width direction Y.

The projection 250 may be positioned between the variable protrusion 217 and the hook protrusion 227 of the storage body 210. In the state in which the storage body 210 is completely coupled to the installation unit 240, the movement of the storage body 210 in the width direction Y may be limited by means of the projection 250.

The hook groove 254 may have a shape which is depressed into the projection 250 in the width direction Y. The movement of the storage body 210 in the upward and downward direction Z may be limited by insertion of the hook protrusion 227 into the hook groove 254. The variable protrusion 217 may be configured so as to be variable in the length by which the variable protrusion 217 projects. According to variation in an amount by which the variable protrusion 217 projects, the storage body 210 may be converted between the fixed state and the separated state.

The installation unit 240 may be provided with a mount detector 260. The mount detector 260 may be pressed by the storage body 210 mounted on the installation unit 240, thus detecting that the storage body 210 is mounted.

The mount detector 260 may detect that the storage body 210 is mounted, by the contact relationships between the mount detector 260 and the storage body 210 mounted on the installation unit 240. The mount detector 260 may be provided at any of various locations, such as the central portion 241, the seating surface 252, and the projection 250.

The mount detector 260 may be pressed by the storage body 210 through direct contact with the storage body 210 or indirect contact with the storage body with a medium interposed therebetween. The portion of the mount detector 260 that is pressed by the storage body 210 may be configured so as to measure pressing force or to be changed in position by pressing force.

When a washing course or the like of the laundry treatment apparatus 1 is performed in the state in which the storage body 210 is not mounted on the installation unit 240, detergent may not be supplied to the inside of the tub 20, and thus a normal washing course may not be performed.

Furthermore, when the storage body 210 is not coupled at the exact position, that is, is not completely coupled even in the state in which the storage body 210 is positioned on the installation unit 240, the detergent may not be supplied.

Furthermore, in the case in which the detergent in the storage body 210 is pumped by means of the detergent pump 400, when the detergent pump 400 is operated in the state in which the storage body 210 is not exactly coupled, air or the like may be introduced into the detergent pump 400, thus causing vibration of or damage to the detergent pump 400.

Accordingly, according to an embodiment of the present disclosure, it is possible to efficiently assure a storage space for detergent by exposing the storage body 210 of the storage 200 to the outside of the cabinet 10, it is possible to improve efficiency of management of the storage body 210 by configuring the storage body 210 to be separable from the cabinet 10, and it is possible to efficiently determine whether or not the storage body 210 is mounted by providing the mount detector 260.

The mount detector 260 may include a detecting protrusion 265. The detecting protrusion 265 may project from the installation unit 240 in the width direction Y, and may be pressed by the storage body 210 mounted on the installation unit 240.

The detecting protrusion 265 may come into contact with the storage body 210. The detecting protrusion 265 may be pressed by the storage body 210, which slides to be mounted to the installation unit 240, and may be changed in position by the pressing force applied by the storage body 210.

According to an embodiment of the present disclosure, because the installation unit 240 is provided with the detecting protrusion 265 which projects in the width direction Y, it is possible to efficient press the detecting protrusion 265 by the storage body 210, which is moved in the width direction Y and is then coupled to the installation unit 240, and thus it is possible to efficiently determine whether the storage body 210 is mounted.

The detecting protrusion 265 may be positioned so as to be aligned with a portion of the storage body 210 in the width direction Y. The detecting protrusion 265 may be disposed so as to overlap a portion of the storage body 210 in the width direction Y. The detecting protrusion 265 may be positioned at an inner side of the storage body 210 in the width direction Y.

The detecting protrusion 265 may be pressed in the width direction Y by the storage body 210 which is completely coupled to the installation unit 240. The detecting protrusion 265 may be pressed and moved by the storage body 210 in the width direction Y. A description of the movement of the detecting protrusion 265 will be given later.

The coupling pipe 242 may be spaced apart from the mount detector 260, and may project in the width direction Y so as to be inserted into the storage body 210. The coupling pipe 242 may project parallel to the detecting protrusion 265. The coupling pipe 242 may project in the width direction Y together with the detecting protrusion 265.

The coupling pipe 242 and the detecting protrusion 265 may be disposed adjacent to each other. Because the detecting protrusion 265 may be disposed adjacent to the coupling pipe 242 and may project in the width direction Y together therewith, it is possible to more directly determine whether or not the coupling pipe 242 is inserted into the storage body 210.

The storage body 210 may include a detergent valve 225 into which the coupling pipe 242 is inserted in the width direction Y so as to allow detergent to be discharged therethrough. The detergent valve 225 may be of a check valve type which allows flow of detergent when the coupling pipe 242 is inserted into the detergent valve 225.

The storage body 210 may be provided with an opening which is open in the width direction Y, and the detergent valve 225 may be provided in the opening. Because the coupling direction of the storage body 210 and the insertion direction of the coupling pipe 242 are almost identical to each other, it is possible to efficiently insert the coupling pipe 242 by the moving force of the storage body 210.

The installation unit 240 may be provided with the central portion 241, which projects upwards, and at least a portion of the mount detector 260 and the coupling pipe 242 may project from the central portion 241 in the width direction Y.

The detecting protrusion 265 and the coupling pipe 242 of the mount detector 260 may project from the central portion 241 in the width direction Y. The detecting protrusion 265 and the coupling pipe 242 may project from the side wall 2415 of the central portion 241 in the width direction Y.

The top cover 100 may include the cover space defined below the installation unit 240, and the cover space may be provided therein with an outflow pipe 410, which is connected to the coupling pipe 242 and though which the discharged from the storage body 210 flows.

In other words, the coupling pipe 242 may be connected to the storage body 210 mounted on the installation unit 240 so as to define a passage through which detergent flows. The detergent in the storage body 210 may be supplied to the tub 20 through the detergent valve 225, the coupling pipe 242, the outflow pipe 410 and the like.

FIG. 10 illustrates the storage bottom portion 220 of the storage body 210 according to an embodiment of the present disclosure. The storage bottom portion 220 may define the lower surface of the storage body 210, and may be positioned on the seating surface 252 and may be seated on the seating surface 252.

The storage body 210 may include the storage main body 213 and the storage cap 214, and may include the facing end 202 which faces the central portion 241 of the installation unit 240. The facing end 202 of the first storage body 211 and the facing end 202 of the second storage body 212 may be disposed so as to face each other.

The facing end 202 may be provided with the facing surface 203. The facing end 202 may be supported by the central portion 241, and the facing surface 203 may be positioned on the central portion 241. The facing surface 203 of the first storage body 211 and the facing surface 203 of the second storage body 212 may be positioned so as to be adjacent to, close to or in contact with each other on the central portion 241.

The storage bottom portion 220 may be defined lower than the facing surface 203. The storage bottom portion 220 may have a shape corresponding to the seating surface 252. At least a portion of the storage bottom portion 220 may have a shape which is inclined downwards moving toward the central portion 241 of the installation unit 240.

The storage bottom portion 220 may be provided with the detergent valve 225. The detergent valve 225 may be open at the storage bottom portion 220 in the width direction Y. Specifically, the coupling pipe 242 may be inserted in the width direction Y into the detergent valve 225 positioned at the storage bottom portion 220.

The storage bottom portion 220 may be provided with a bottom damper 223. The bottom damper 223 may project downwards from the storage bottom portion 220. The bottom damper 223 may have the form of a column which extends downwards from the storage bottom portion 220. The bottom damper 223 may be in contact with the seating surface 252 so as to support the storage bottom portion 220 by the seating surface 252.

The bottom damper 223 may include a plurality of bottom dampers 223. The bottom dampers 223 may be disposed so as to overlap the detergent valve 225 in the forward and backward direction. The detergent valve 225 may be positioned between a pair of bottom dampers 223.

In the state in which the storage body 210 is completely coupled to the installation unit 240, the bottom dampers 223 may face the central portion 241 in the width direction Y. The bottom dampers 223 may face the side wall 2425 of the central portion 241, and may be positioned close to and adjacent to the side wall 2415.

The variable protrusion 217 may project downwards from the storage bottom portion 220. The variable protrusion 217 may be configured so as to be variable in a length by which the variable protrusion 217 projects. The storage body 210 may be provided with a variable button which is operated in conjunction with the variable protrusion 217, and the amount of projection and the position of the variable protrusion 217 may be changed according to the extent of manipulation of the variable button.

The hook protrusion 227 may project from the storage bottom portion 220 in the width direction Y. The hook protrusion 227 may project from the storage bottom portion 220 toward the inner side of the installation unit 240 in the width direction Y. The hook protrusion 227 may inserted into the hook groove 254 in the projection 250 provided at the installation unit 240.

FIG. 11 illustrates the mount detector 260 provided at the installation unit 240 according to an embodiment of the present disclosure. The mount detector 260 may include a detecting body 261. The detecting body 261 may be disposed in the installation unit 240.

The detecting protrusion 265 may project from the detecting body 261, and may pass through the installation unit 240 and may be exposed to the outside of the installation unit 240. In other words, the detecting body 261 may be provided in the installation unit 240, and the detecting protrusion 265 projecting from the detecting body 261 may be exposed to the outside of the installation unit 240 through one surface of the installation unit 240.

The detecting body 261 may be configured to generate a signal based on variation occurring at the detecting protrusion 265. For example, the detecting protrusion 265 may be pressed and moved by the storage body 210 which slides and is then coupled to the installation unit 240, and the detecting body 261 may generate an electrical signal depending on the moved position of the detecting protrusion 265.

The installation unit 240 may be provided with the central portion 241 which projects upwards, and at least a portion of the detecting body 261 may be positioned in the central portion 241. In other words, the central portion 241, which projects upwards from the installation unit 240, may have a space defined therein, and the detecting body 261 may be disposed in the central portion 241.

The space defined in the central portion 241 may communicate with the rear space of the top cover 100. The space defined in the central portion 241 may form a portion of the rear space of the top cover 100.

The detecting protrusion 265 may extend through the side wall of the central portion 241. Specifically, the central portion 241 may include the upper surface, which faces upwards, and the side wall, which is connected to the seating surface 252 at each of opposite sides of the upper surface. The detecting protrusion 265 may extend through the side wall and may be positioned above the seating surface 252. The detecting protrusion 265 and the coupling pipe 242 may be spaced apart from each other in the forward and backward direction X.

According to an embodiment of the present disclosure, the storage body 210 may include a pair of storage bodies. The installation unit 240 may include the first storage body 210 and the second storage body 212. The pair of storage bodies 210 may slide toward each other and may be coupled to the installation unit 240.

The mount detector 260 may include a plurality of mount detectors. Some of the plurality of mount detectors may detect mounting of one of the pair of storage bodies 210, and the remaining one of the plurality of mount detectors may detect mounting of the other of the pair of storage bodies 210.

In other words, the mount detector 260 may include at least two mount detectors, one of which may be provided at one of the pair of side walls of the central portion 241 and the other of which may be provided the other of the pair of side walls of the central portion 241.

By virtue of the plurality of mount detectors 260 provided at the central portion 241, it is possible to respectively detect mount the first storage body 211 and the second storage body 212.

FIG. 12 illustrates the storage body 210 which is separated from the installation unit 240. FIG. 13 illustrates the storage body 210 which is completely coupled to the installation unit 240.

Referring to FIG. 12, in order to couple the storage body 210 to the installation unit 240, the variation protrusion 217 may be manipulated so as to be reduced in the projecting amount thereof. A user may manipulate the variation button to move the variation protrusion 217 such that the variation protrusion 217 does not project from the storage bottom portion 220.

When the variation protrusion 217 is retracted into the storage bottom portion, the storage body 210 may be allowed to be moved on the installation unit 240 in the width direction Y. Here, when the storage body 210 is spaced apart from the central portion 241 by a predetermined distance or more, the detecting protrusion 265 may not be in contact with the storage body 210.

At this time, the coupling pipe 242 may be spaced apart from the detergent valve 225 of the storage body 210, or may be in the state of not being sufficiently inserted into the detergent valve 225. When the coupling pipe 242 is in the state of not being sufficiently inserted into the detergent valve 225, the detergent in the storage body 210 may not normally flow to the coupling pipe 242.

Specifically, the maximum length by which the detecting protrusion 265 projects from the side wall of the central portion 241 may be less than the length by the coupling pipe 242 projects from the side wall. Accordingly, the detecting protrusion 265 may detect the mounted state of the storage body 210 which corresponds to not the state in which the coupling pipe 242 is incompletely inserted into the detergent valve 225 but the state in which the coupling pipe 242 is normally inserted into the detergent valve 225.

When the storage body 210 is not completely coupled to the installation unit 240, the hook protrusion 227 of the storage body 210 may be in the state of not being completely inserted into the hook groove 254 in the installation unit 240.

Referring to FIG. 13, the storage body 210 may slide toward the central portion 241 of the installation unit 240 and may be completely coupled to the installation unit 240 until the movement of the storage body 210 in the width direction Y is limited due to contact with the central portion 241, mutual contact of the pair of storage bodies 210, or insertion of the hook protrusion 227 into the hook groove 254.

When the storage body 210 is completely coupled to the installation unit, the distance between the storage body 210 and the side wall of the central portion 241 may be less than the maximum projecting length of the detecting protrusion 265. In other words, when the storage body 210 is completely coupled, the projecting length of the detecting protrusion 265 may be reduced because the detecting protrusion 265 is pressed and moved by the storage body 210.

The detecting body 261 may generate an electrical signal indicating the mounted state of the storage body 210 when the projecting length of the detecting protrusion 265 decreases to a predetermined length or less. The coupling pipe 242, which projects longer than the detecting protrusion 265, may be inserted into the detergent valve 225 by a sufficient length when the storage body 210 is completely coupled.

The detergent valve 225 may project downwards from the storage bottom portion 220, and may be almost aligned with the coupling pipe 242 in the width direction Y. The detecting protrusion 265 may be pressed and moved by a portion of the storage body 210. The detecting protrusion 265 may be pressed and moved by the bottom damper 223 which projects from the storage bottom portion 220.

In order to fix the position of the storage body 210 in the width direction Y in the state in which the storage body 210 is completely coupled, that is, the coupling pipe 242 is sufficiently inserted, the variable protrusion 217 may move and project downwards from the storage bottom portion 220.

A user may limit the movement of the storage body 210 in the width direction Y and may stably fix the storage body 210 to the installation unit 240 by moving the storage body 210 until the movement of the storage body 210 in the width direction Y is limited and then by manipulating the variable button to project the variable protrusion 217.

The hook protrusion 227 may be inserted into the hook groove 254 in conjunction with movement of the storage body 210. By virtue of the variable protrusion 217 coming into contact with the protrusion support surface 255 of the projection 250 and the hook protrusion 227 being inserted into the hook groove 254, the movement of the storage body 210 toward opposite sides in the width direction Y may be limited and fixed.

As described above, the installation unit 240 may be provided in the center thereof with the central portion 241 which project upwards, and the pair of storage bodies 210 may slide toward the central portion 241 and may be mounted on the installation unit 240.

Some of the plurality of mount detectors 260 may include the detecting protrusion 265 which projects toward one side in the width direction Y, and the remaining one of the plurality of mount detectors 260 may include the detecting protrusion 265 which projects from the central portion 241 toward the opposite side in the width direction Y.

The pair of storage bodies 210 may include the facing surfaces 203, which are positioned on the central portion 241 and face each other, and may press the detecting protrusions 265 below the facing surfaces 203. In other words, the facing surfaces of the storage bodies 210 may be positioned on the upper surface of the central portion 241, and the detecting protrusion 265 may be disposed at the side walls of the central portion 241.

The storage bottom portion 220 of the storage body 210 may be positioned lower than the facing surface 203 and may define the lower surface of the storage body 210, and the bottom damper 223 may extend downwards from the storage bottom portion 220 to support the storage bottom portion 220 with respect to the installation unit 240. The bottom damper 223 may be positioned at one side in the width direction Y, and may press the detecting protrusion 265.

FIG. 14 is a view illustrating the rear space of the top cover 100 according to an embodiment of the present disclosure. The rear space of the top cover 100 may be provided therein with various components such as the receiving case 310 of the internal storage 300 and the detergent pump 400.

Specifically, the top cover 100 may include the cover space which is positioned below the installation unit 240. The cover space may be provided therein with a control module which is connected to the mount detector 260 so as to receive the value resulting from the detection of the mount detector 260.

The control module may determine whether or not the storage body 210 is mounted, depending on the value of detection transmitted from the mount detector 260. The control module may be the pump control module 510, which is connected to the detergent pump 400 to control operation of the detergent pump 400.

Specifically, the cover space may be provided therein with the detergent pump 400, which communicates with the storage body 210 to pump the detergent, and the control module may be connected to the detergent pump 400 so as to control operation of the detergent pump 400.

When the control module determines that the storage body 210 is not mounted, based on the value of detection of the mount detector 260, the control module may halt the operation of the detergent pump 400, and may generate a signal requesting mounting of the storage body 210.

The storage body 210 may include a plurality of storage bodies, the detergent pump 400 may include a plurality of detergent pumps, which are respectively connected to the plurality of storage bodies 210, and the plurality of detergent pumps 400 may be aligned with each other in the cover space in the width direction Y. At least one of the plurality of detergent pumps 400 may be disposed above the control module.

Although the present disclosure has been illustrated and described with reference to the specific embodiments, those skilled in the art will appreciate that various modifications, additions and substitutions are possible, without departing from the scope and spirit of the present disclosure as disclosed in the accompanying claims.

What is claimed is:

1. A laundry treatment apparatus comprising:

a cabinet comprising a top cover having an introduction opening;

a tub located in the cabinet, the tub being configured to store water therein, the tub having a tub opening facing the introduction opening; and a storage located at the top cover, the storage including:

an installation unit located at the top cover, the installation unit including a central portion protruding upwards, the central portion having a side wall;

a storage body exposed to outside of the cabinet, the storage body being configured to store detergent therein, the storage body being removably mounted to the installation unit in a width direction of the cabinet; and a mount detector located at the installation unit, the mount detector being configured to detect mounting of the storage body when the storage body is mounted on the installation unit, the mount detector including:

a detecting body located in the installation unit, a portion of the detecting body being located in the central portion, a detecting protrusion extending from the installation unit in the width direction of the cabinet, the detecting protrusion being configured to be pressed by the storage body mounted on the installation unit, the detecting protrusion extending from the detecting body through the side wall of the central portion to be exposed to an outside of the installation unit, wherein the installation unit further comprises a coupling pipe configured to be inserted into the storage body so as to communicate with an inside of the storage body, and wherein the coupling pipe projects in a same direction as a direction in which the mount detector projects.

2. The laundry treatment apparatus of claim 1, wherein the detecting protrusion is configured to move in the width direction when pressed by the storage body.

3. The laundry treatment apparatus of claim 1, wherein the storage body comprises a detergent valve into which the coupling pipe is inserted in the width direction when the storage body is mounted to the installation unit, the detergent valve being configured to discharge detergent to the coupling pipe.

4. The laundry treatment apparatus of claim 1, wherein a portion of the mount detector and a portion of the coupling pipe extend from the central portion in the width direction of the cabinet.

5. The laundry treatment apparatus of claim 1, further comprising an outflow pipe connected to the coupling pipe, wherein the top cover comprises a cover space located below the installation unit, the outflow pipe being located in the cover space.

6. The laundry treatment apparatus of claim 1, wherein the storage body comprises a first storage body and a second storage body, the first storage body and the second storage body being slidable toward each other on the installation unit to be coupled to the installation unit, and wherein the mount detector comprises:

a first mount detector configured to detect the first storage body; and a second mount detector configured to detect the second storage body.

7. The laundry treatment apparatus of claim 6, wherein the first storage body and the second storage body are configured to slide toward the central portion to be mounted on the installation unit, wherein the first mount detector includes a first detecting protrusion extending from a first side of the central portion, and wherein the second mount detector includes a second detecting protrusion extending from a second side of the central portion.

8. The laundry treatment apparatus of claim 7, wherein the first storage body has a first facing surface, the first facing surface being located at the central portion, and wherein the second storage body has a second facing surface configured to face the first facings surface of the first storage body, the second facing surface being located at the central portion.

9. The laundry treatment apparatus of claim 8, wherein each of the first detecting protrusion and the second detecting protrusion is located lower than the first facing surface and the second facing surface, respectively.

10. The laundry treatment apparatus of claim 9, wherein the first storage body includes a first storage bottom positioned lower than the first facing surface, the first storage bottom having a first bottom damper to support the first storage bottom on the installation unit, the first bottom damper being configured to press the first detecting protrusion, and wherein the second storage body includes a second storage bottom positioned lower than the second facing surface, the second storage bottom having a second bottom damper to support the second storage bottom on the installation unit, the second bottom damper being configured to press the second detecting protrusion.

11. The laundry treatment apparatus of claim 1, further comprising a control module connected to the mount detector, the control module being configured to receive a value of detection from the mount detector, wherein the top cover comprises a cover space located below the installation unit, the control module being located in the cover space.

12. The laundry treatment apparatus of claim 11, further comprising a detergent pump located in the cover space, the detergent pump being configured to pump detergent from the storage body, wherein the control module is connected to the detergent pump to control operation of the detergent pump.

13. The laundry treatment apparatus of claim 12, wherein the control module is configured to, when the control module determines that the storage body is not mounted based on the value of detection of the mount detector:

halt operation of the detergent pump; and generate a signal requesting mounting of the storage body.

14. The laundry treatment apparatus of claim 12, wherein the storage body comprises a first storage body and a second storage body, wherein the detergent pump comprises a first detergent pump and a second detergent pump, the first detergent pump and the second detergent pump being configured to be connected to the first storage body and the second storage body, respectively, and wherein the first detergent pump and the second detergent pump are aligned with each other in the width direction of the cabinet in the cover space.

15. The laundry treatment apparatus of claim 14, wherein the first detergent pump is located above the control module.

16. The laundry treatment apparatus of claim 1, wherein the installation unit includes a hook groove, and wherein the storage body includes a hook protrusion configured to be inserted in the hook groove.

* * * * *